US010152913B1

(12) United States Patent
Lin et al.

(10) Patent No.: US 10,152,913 B1
(45) Date of Patent: Dec. 11, 2018

(54) ANTI-INTERFERENCE DISPLAY PANEL AND ANTI-INTERFERENCE SIGNAL LINE

(71) Applicant: AU Optronics Corporation, Hsin-Chu (TW)

(72) Inventors: Yi-Cheng Lin, Hsin-Chu (TW); Ming-Hsien Lee, Hsin-Chu (TW); Kai-Wei Hong, Hsin-Chu (TW); Chun-Da Tu, Hsin-Chu (TW); Chuang-Cheng Yang, Hsin-Chu (TW); Chun-Feng Lin, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 15/830,386

(22) Filed: Dec. 4, 2017

(30) Foreign Application Priority Data

Sep. 14, 2017 (TW) ..... 106131635 A

(51) Int. Cl.
*G09G 3/20* (2006.01)

(52) U.S. Cl.
CPC ..... *G09G 3/2092* (2013.01); *G09G 2300/043* (2013.01); *G09G 2300/0426* (2013.01); *G09G 2300/0876* (2013.01); *G09G 2310/0254* (2013.01); *G09G 2310/0297* (2013.01); *G09G 2354/00* (2013.01)

(58) Field of Classification Search
None
See application file for complete search history.

(56) References Cited

U.S. PATENT DOCUMENTS 5,631,666 A 5/1997 Tagawa et al.
8,406,028 B1 3/2013 Lin et al.
2007/0236620 A1* 10/2007 Yan ..... G02F 1/136286 349/33

(Continued)

FOREIGN PATENT DOCUMENTS

TW 201030724 A 8/2010
TW I591617 7/2017

OTHER PUBLICATIONS

Taiwan Intellectual Property Office, "Office Action", dated Jul. 2, 2018.

*Primary Examiner* — Nicholas Lee
(74) *Attorney, Agent, or Firm* — WPAT, PC

(57) ABSTRACT

An anti-interference display panel includes a source driving chip, a switching signal line, a multiplexer, and an anti-interference signal line. The source driving chip is configured to generate a data signal. The switching signal line is configured to transmit a switching signal. The multiplexer is configured to receive the data signal and the switching signal, and is configured to output the data signal according to the switching signal. The anti-interference signal line is configured to transmit an anti-interference signal. An equivalent resistor and an equivalent capacitor are formed on the anti-interference signal line, and resistance of the equivalent resistor is approximate to resistance of a load resistor coupled to the switching signal line, and capacitance of the equivalent capacitor is approximate to capacitance of a load capacitor coupled to the switching signal line. A voltage of the anti-interference signal falls when a voltage of the switching signal rises, and rises when the voltage of the switching signal falls.

20 Claims, 6 Drawing Sheets

(56) References Cited

U.S. PATENT DOCUMENTS

| | | | | |
|---|---|---|---|---|
| 2009/0002355 | A1* | 1/2009 | Iwatsu | G09G 3/3688 345/205 |
| 2016/0005358 | A1* | 1/2016 | Wang | G09G 3/3233 345/212 |

* cited by examiner

ANTI-INTERFERENCE DISPLAY PANEL AND ANTI-INTERFERENCE SIGNAL LINE

BACKGROUND

Technical Field

The present disclosure relates to a display panel and line, and in particular, to an anti-interference display panel and an anti-interference signal line that are capable of reducing noise interference.

Related Art

In a conventional display panel, source driving chips are used together with a multiplexer, to reduce the quantity of needed source driving chips. However, driving a plurality of switching signals needed by the multiplexer causes interference to an active area of the display panel by means of a capacitance coupling effect, and therefore reduces the user experience to the display panel.

SUMMARY

In view of this, how to provide an anti-interference display panel and an anti-interference signal line that are capable of reducing noise interference is really a problem to be resolved in the industry.

An anti-interference display panel includes a source driving chip, a switching signal line, a multiplexer, and an anti-interference signal line. The source driving chip is configured to generate a data signal. The switching signal line is configured to transmit a switching signal. The multiplexer is configured to receive the data signal and the switching signal, and is configured to output the data signal according to the switching signal. The anti-interference signal line is configured to transmit an anti-interference signal, where an equivalent resistor and an equivalent capacitor are formed on the anti-interference signal line, and resistance of the equivalent resistor is approximate to resistance of a load resistor coupled to the switching signal line, and capacitance of the equivalent capacitor is approximate to capacitance of a load capacitor coupled to the switching signal line. A voltage of the anti-interference signal falls when a voltage of the switching signal rises, and rises when the voltage of the switching signal falls.

An anti-interference signal line is configured to transmit an anti-interference signal to reduce a coupling effect caused by a switching signal on a switching signal line, where an equivalent resistor and an equivalent capacitor are formed on the anti-interference signal line, and resistance of the equivalent resistor is approximate to resistance of a load resistor coupled to the switching signal line, and capacitance of the equivalent capacitor is approximate to capacitance of a load capacitor coupled to the switching signal line. A voltage of the anti-interference signal falls when a voltage of the switching signal rises, and rises when the voltage of the switching signal falls.

BRIEF DESCRIPTION OF THE DRAWINGS

To make the aforementioned and other objective, features, advantages, and embodiments of the present disclosure comprehensible, the accompanying drawings are described as follows.

DETAILED DESCRIPTION

Embodiments of the present invention will be described below with reference to related figures. In the figures, same reference signal represent same or similar elements or method processes.

Figure 1:
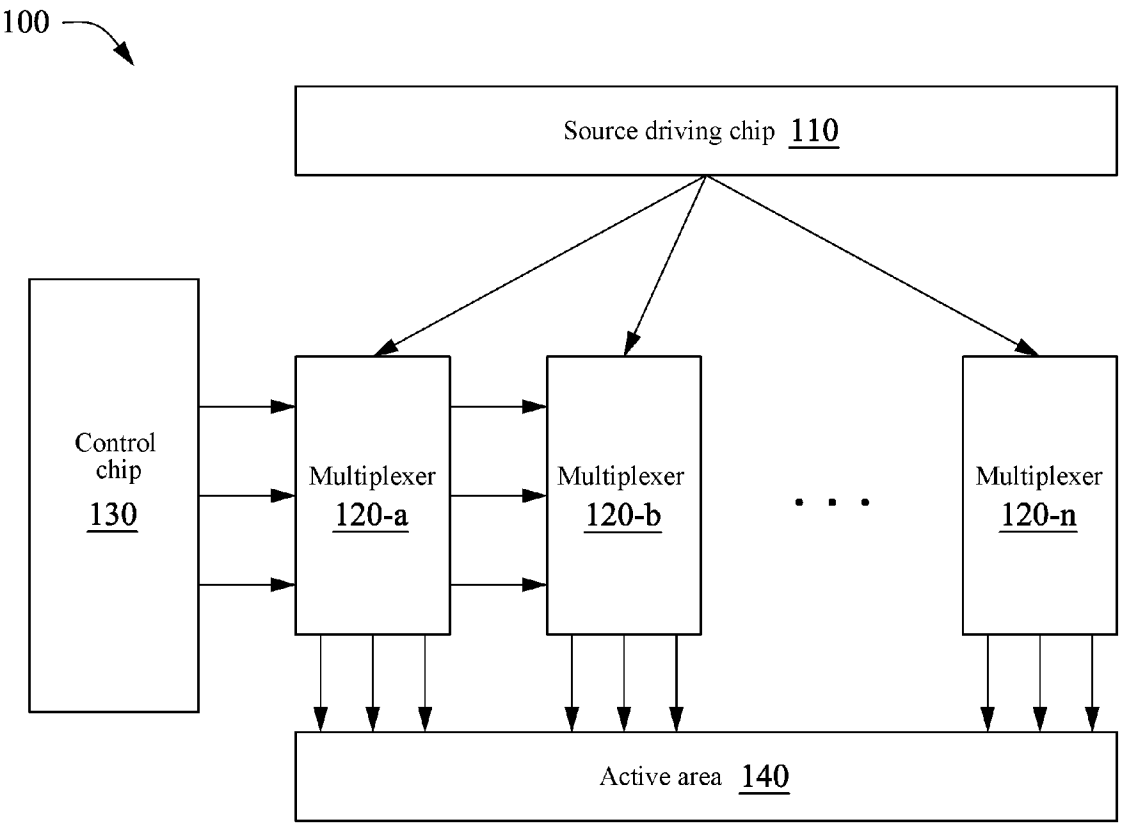
FIG. 1 is a simplified functional block diagram of a display panel according to an embodiment of the present disclosure.

FIG. 1 is a simplified functional block diagram of a display panel 100 according to an embodiment of the present disclosure. As shown in FIG. 1, the display panel 100 includes a source driving chip 110, a plurality of multiplexers 120-*a* to 120-*n*, a control chip 130, and an active area 140. The source driving chip 110 is configured to respectively output a plurality of data signals to the multiplexers 120-*a* to 120-*n*. Each of the multiplexers 120 is configured to output, according to a plurality of switching signals transmitted by the control chip 130, a received data signal to a corresponding source signal line in the active area 140, to control the active area 140 to display a display image. To make the figure brief for ease of description, other elements and connection relationships in the display panel 100 are not drawn in FIG. 1.

Because the foregoing switching signals are periodic clock signals, and parasitic capacitance inevitably exists between the active area 140 and a plurality of signal lines transmitting the switching signals, alternating components of the switching signals are transmitted to the active area 140 by means of the capacitance coupling effect, causing interference to image display of the active area 140. Moreover, if the active area 140 also has the function of detecting a touch signal in addition to the display function, the touch signal detected by the active area 140 is also interfered by the switching signals.

Figure 2:
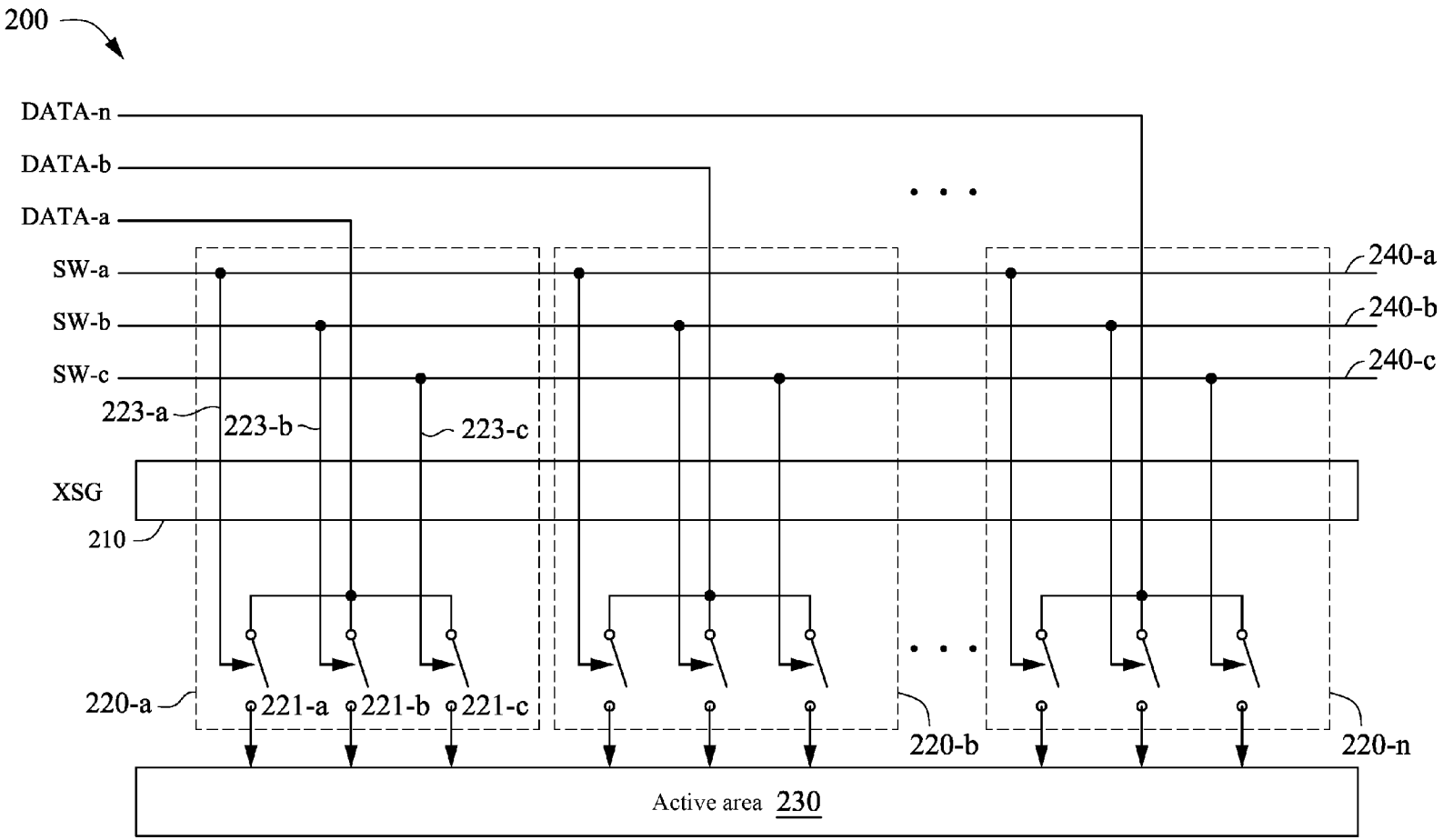
FIG. 2 is a simplified functional block diagram of an anti-interference display panel according to an embodiment of the present disclosure.

To resolve the foregoing interference problem caused by the switching signals, the present disclosure provides an anti-interference display panel 200. A simplified functional block diagram of an embodiment of the anti-interference display panel 200 is drawn in FIG. 2. As shown in FIG. 2, the anti-interference display panel 200 includes an anti-interference signal line 210, a plurality of multiplexers 220-*a* to 220-*n*, an active area 230, and a plurality of switching signal lines 240-*a* to 240-*c*. The switching signal lines 240-*a* to 240-*c* are respectively configured to transmit switching signals SW-a to SW-c. The anti-interference signal line 210 is configured to transmit an anti-interference signal XSG.

The multiplexers 220-*a* to 220-*n* are respectively configured to receive data signals DATA-a to DATA-n, and each of the multiplexers 220 includes a plurality of switches 221-*a* to 221-*c* and a plurality of configuration signal lines 223-*a* to 223-*c*. First ends of the switches 221-*a* to 221-*c* are all used to receive data signals DATA, and second ends of the switches 221-*a* to 221-*c* are respectively coupled to corresponding source signal lines in the active area 230. In addition, a control end of the switch 221-*a* is used to receive the switching signal SW-a by using the configuration signal line 223-*a*, a control end of the switch 221-*b* is used to receive the switching signal SW-b by using the configuration signal line 223-*b*, and a control end of the switch 221-*c* is used to receive the switching signal SW-c by using the configuration signal line 223-*c*.

The multiplexer 220 correspondingly outputs the data signal DATA to one of the plurality of source signal lines corresponding to the switches 221-*a* to 221-*c* according to voltage levels of the switching signals SW-a to SW-c. For example, if a voltage of a switching signal SW1 is in a high level, and voltages of switching signals SW2 and SW3 are both in a low level, the switch 221 is conducted and switches 223 and 225 are turned off. In this case, the multiplexer 220 outputs the data signal DATA to a source signal line corresponding to the switch 221.

During implementation, the anti-interference signal line 210 may be disposed between switches 221-*a* to 221-*n* and any switching signal line 240, but is not electrically connected to the multiplexers 220-*a* to 220-*n*. For briefness in narration, the following description is provided by using an example that the anti-interference signal line 210 is disposed between the switches 221-*a* to 221-*n* and the switching signal line 240-*c*.

Lowercase English indexes a to c and a to n in reference signs of elements and reference signs of signals used in the specification and accompanying drawings of the present application are merely for the purpose of convenience of referring to individual elements and signals, and are not intended to limit the quantities of the foregoing elements and signals to specific numbers. In the specification and accompanying drawings of the present application, if an index of an element reference sign or a signal reference sign is not specified when the element reference sign or the signal reference sign is used, it indicates that the element reference sign or signal reference sign refers to any non-specific element or signal in an element group or a signal group to which the element or signal belongs. For example, an object to which the element reference sign 220-*a* refers is the multiplexer 220-*a*, and an object to which the element reference sign 220 refers is any non-specific multiplexer 220 in the multiplexers 220-*a* to 220-*n*. For another example, an object to which the signal reference sign DATA-a refers is the data signal DATA-a, and an object to which the signal reference sign DATA refers is any non-specific data signal DATA in the data signals DATA-a to DATA-n. For another example, an object to which the signal reference sign SW-a refers is the switching signal SW-a, and an object to which the signal reference sign SW refers is any non-specific switching signal SW in the switching signals SW-a to SW-c.

Figure 3:
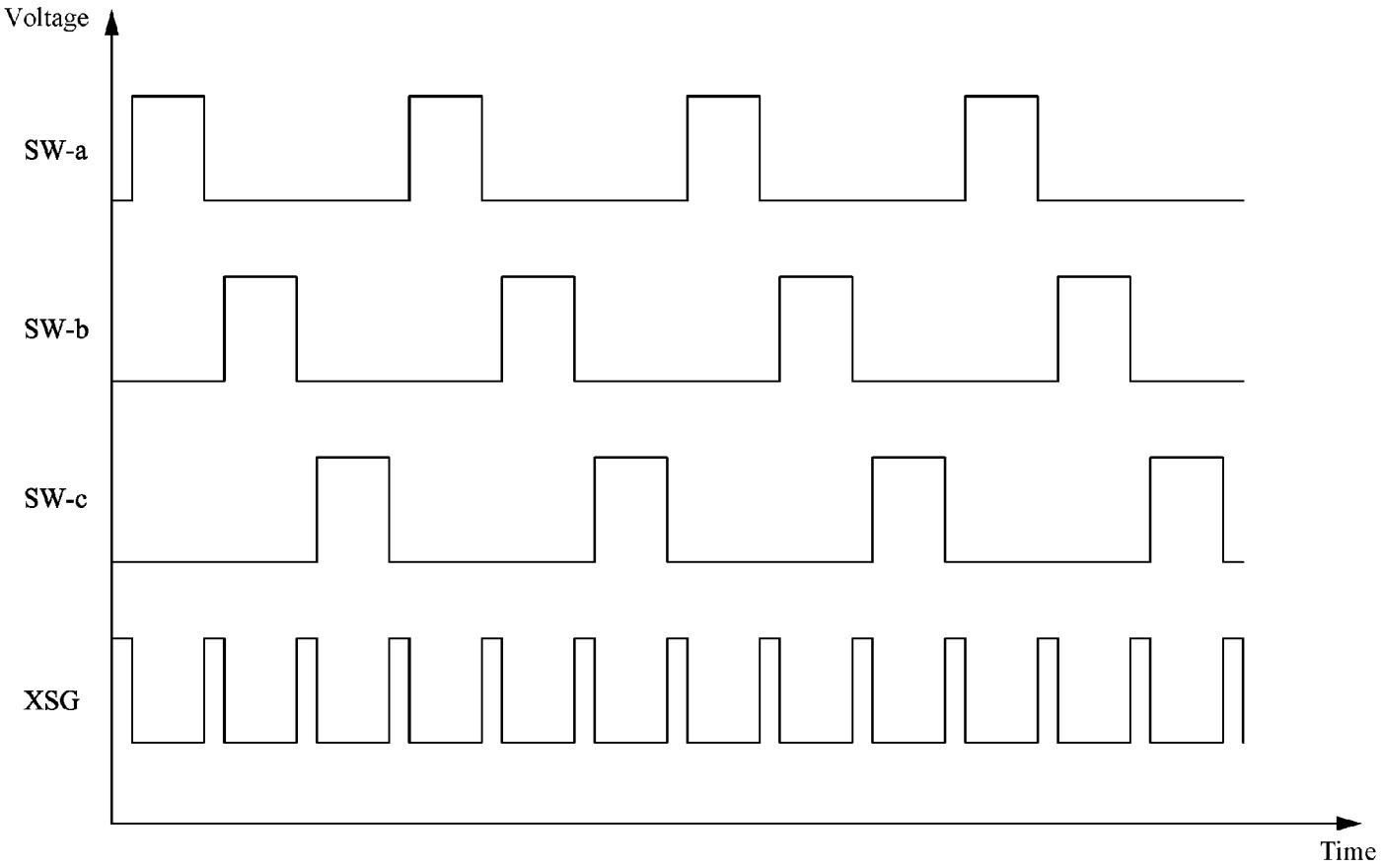
FIG. 3 is a simplified timing diagram of an operation embodiment of the anti-interference display panel of FIG. 2.

FIG. 3 is a simplified timing diagram of an embodiment of the anti-interference display panel 200 of FIG. 2. As shown in FIG. 3, the switching signals SW-a to SW-c are periodic clock signals with different phases. When a voltage of any one of the switching signals SW-a to SW-c is in a highest level, voltages of the other two switching signals are in a lowest level. A voltage of the anti-interference signal XSG is set to rise when the voltage of the switching signal SW falls, and fall when the voltage of the switching signal SW rises. In other words, when the voltage of any one of the switching signals SW-a to SW-c changes, the voltage of the anti-interference signal XSG correspondingly reversely changes.

Referring to both FIG. 2 and FIG. 3, because parasitic capacitance exists between the switching signal line 240 and the active area 230, an alternating component of the switching signal SW is transmitted to the active area 230 by means of the capacitance coupling effect. In other words, when the voltage of the switching signal SW rises, a voltage change of the switching signal SW causes a positive pulse signal in the active area 230, and when the voltage of the switching signal SW falls, a voltage change of the switching signal SW causes a negative pulse signal in the active area 230.

Similarly, because parasitic capacitance also exists between the anti-interference signal line 210 and the active area 230, when the voltage of the anti-interference signal XSG rises, a voltage change of the anti-interference signal XSG causes a positive pulse signal in the active area 230, and when the voltage of the anti-interference signal XSG falls, a voltage change of the anti-interference signal XSG causes a negative pulse signal in the active area 230.

It can be known according to the foregoing content that, when the switching signal SW cases a pulse signal in the active area 230, the anti-interference signal XSG also correspondingly causes a pulse signal in the active area 230. In addition, the pulse signal caused by the anti-interference signal XSG can be enabled, only by setting maximum and minimum voltages of the anti-interference signal XSG, to be approximately reversely symmetrical to the pulse signal caused by the switching signal SW. In this way, the pulse signal caused by the anti-interference signal XSG is counterbalanced, to some extent, with the pulse signal caused by the switching signal SW, thereby alleviating interference caused by all the switching signals SW-a to SW-c to the active area 230.

It should be noted that, to enable the pulse signal caused by the anti-interference signal XSG to be approximately reversely symmetrical to the pulse signal caused by the switching signal SW, slopes of a rising edge and a falling edge of the anti-interference signal XSG need to be approximated to slopes of rising edges and falling edges of the switching signals SW-a to SW-c. Therefore, resistance of an equivalent resistor on the anti-interference signal line 210 and capacitance of an equivalent capacitor on the anti-interference signal line 210 need to be approximated to resistance of a load resistor on the switching signal line 240 and capacitance of a load capacitor on the switching signal line 240.

Figure 4:
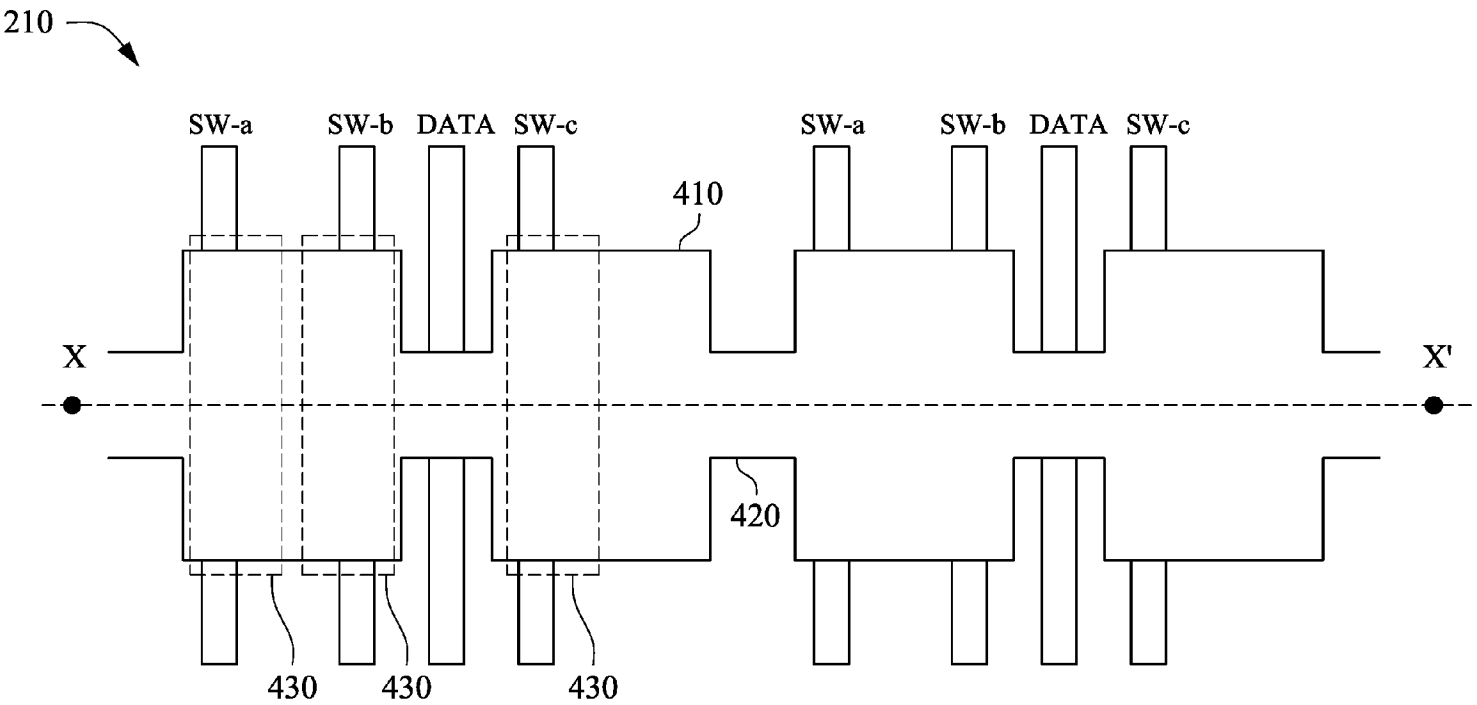
FIG. 4 is a simplified partial top view of an embodiment of an anti-interference signal line of FIG. 2.

FIG. 4 is a simplified partial top view of an embodiment of the anti-interference signal line 210 of FIG. 2. As shown in FIG. 4, the anti-interference signal line 210 includes a plurality of first areas 410, a plurality of second areas 420, and a plurality of anti-interference units 430. An anti-interference unit 430 is disposed on a part where the anti-interference signal line 210 overlaps with each of the configuration signal lines 223.

The first area 410 and the second area 420 are used to form an equivalent resistor on the anti-interference signal line 210, and the resistance of the equivalent resistor on the anti-interference signal line 210 is approximate to the resistance of the load resistor on the switching signal lines 240.

The anti-interference unit 430 is used to form an equivalent capacitor on the anti-interference signal line 210, and the capacitance of the equivalent capacitor on the anti-interference signal line 210 is approximate to the capacitance of the load capacitor on the switching signal lines 240.

The conductor width of the anti-interference signal line 210 in the first area 410 and the second area 420 is particularly designed. The first area 410 has a relatively large conductor width, and therefore has relatively low impedance, and the second area 420 has a relatively small conductor width, and therefore has relatively high impedance.

By alternately disposing the first area 410 having low impedance and the second area 420 having high impedance, the equivalent resistor whose resistance is approximate to the resistance of the load resistor on the switching signal line 240 may be formed on the anti-interference signal line 210.

In the embodiment of FIG. 4, the switches 221-*a* to 221-*c* are implemented by means of N type field effect transistors. Therefore, load capacitors on the switching signal lines 240-*a* to 240-*c* all have capacitances that dynamically change.

Specifically, gate capacitance when the field effect transistor is conducted is greater than gate capacitance when the field effect transistor is turned off, and the switching signal lines 240-*a* to 240-*c* are respectively coupled to gates of the switches 221-*a* to 221-*c*. Therefore, when the switch 221 is switched from a turned-off state to a truned on state, the capacitance of the load capacitor on the corresponding switching signal line 240 increases. Correspondingly, when the switch 221 is switched from the turned on state to the turned-off state, the capacitance of the load capacitor on the corresponding switching signal line 240 decreases.

Figure 5:
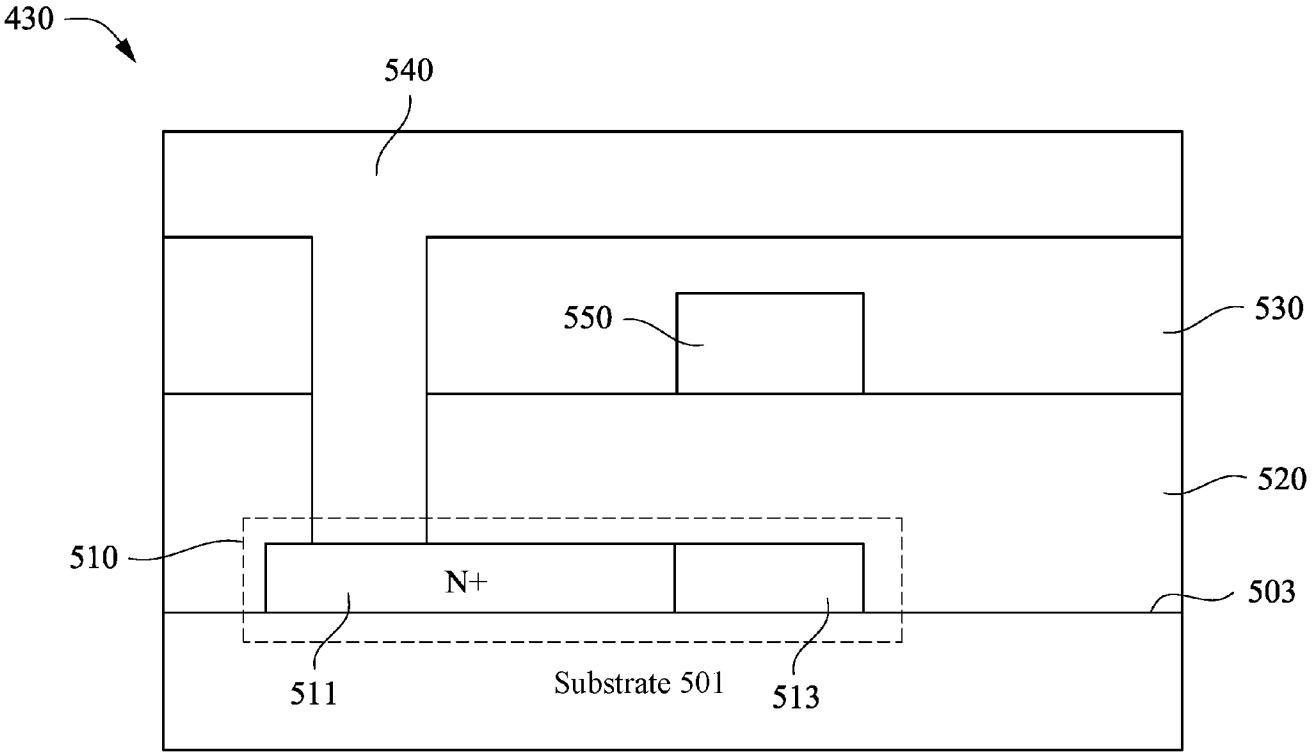
FIG. 5 is a simplified partial cross-sectional view of one anti-interference unit of FIG. 4 on a straight line X-X'.
Figure 6:
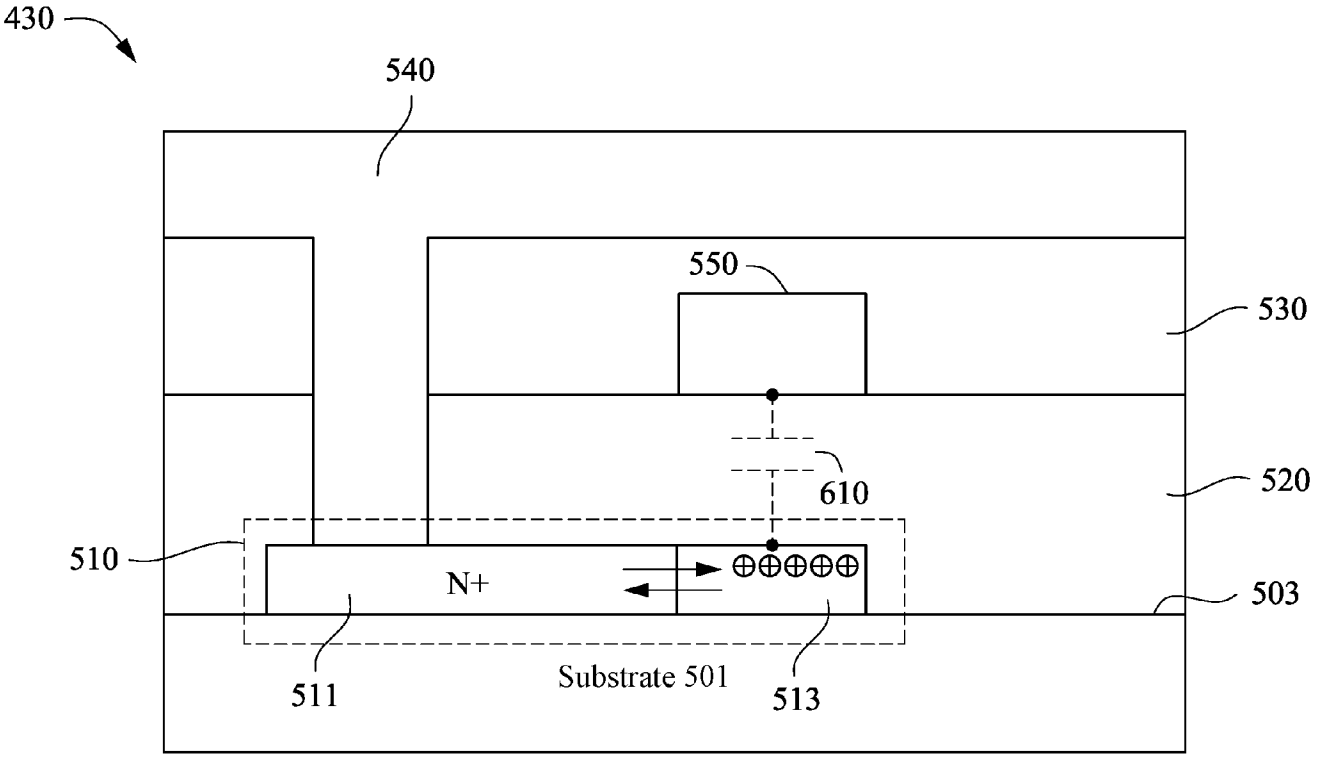
FIG. 6 is a simplified cross-sectional view of an operation embodiment of the anti-interference unit in FIG. 5.

In this embodiment, to enable the capacitance of the equivalent capacitor on the anti-interference signal line 210 to dynamically match the capacitance of the load capacitor on the switching signal line 240, each of the anti-interference units 430 is set as a variable capacitor for providing capacitance that dynamically changes of the anti-interference signal line 210. Refer to FIG. 5, FIG. 6, and subsequent descriptions for the structure and operation embodiment of the anti-interference unit 430.

It should be noted that the partial top view of the anti-interference signal line 210 in the foregoing FIG. 4 is merely an exemplar embodiment, and is not intended to limit the actual implementation of the present invention. For example, in some embodiments, the anti-interference units 430 are disposed only on some of parts where the anti-interference signal line 210 overlaps with a plurality of configuration signal lines 223, and are not disposed on all parts where the anti-interference signal line 210 overlaps with the configuration signal lines 223.

FIG. 5 is a simplified partial cross-sectional view of one anti-interference unit 430 of FIG. 4 on a straight line X-X'. As shown in FIG. 5, the anti-interference unit 430 includes a semiconductor layer 510, a first insulation layer 520, a second insulation layer 530, a first conductive layer 540, and a second conductive layer 550. The semiconductor layer 510 is disposed on a surface 503 of a substrate 501. The first insulation layer 520 is bonded to the surface 503 and the semiconductor layer 510. The second insulation layer 530 is bonded to the first insulation layer 520, and the second insulation layer 530 and the first insulation layer 520 together cover the second conductive layer 550. The first conductive layer 540 is bonded to the second insulation layer 530, and is partially bonded to the semiconductor layer 510 through a via hole penetrating through the first insulation layer 520 and the second insulation layer 530. In addition, the second conductive layer 550 is located between the first conductive layer 540 and the semiconductor layer 510.

During implementation, the first insulation layer 520 and/or the second insulation layer 530 may be implemented by using a plurality of layers of different insulation materials.

Refer to both FIG. 4 and FIG. 5. The first conductive layer 540 forms a surface of the anti-interference signal line 210, and is used to transmit the anti-interference signal XSG. The second conductive layer 550 is the configuration signal line 223 for receiving the switching signal SW by the multiplexer 220.

In other words, each configuration signal line 223 penetrates through a corresponding anti-interference unit 430, and a part, located in the anti-interference unit 430, of the configuration signal line 223 is used to form the second conductive layer 550 of the anti-interference unit 430.

The semiconductor layer 510 is formed by a first type doped area 511 and a second type doped area 513. The first type doped area 511 is bonded to the first conductive layer 540, and the second doped area 513 is located in a closed area formed by the first type doped area 511, the first insulation layer 520, and the surface 503, and is not bonded to the first conductive layer 540.

In addition, a projection, formed on the surface 503, of the second conductive layer 550 overlaps with the second type doped area 513. That is, the second type doped area 513 is located between the second conductive layer 550 and the substrate 501. In this embodiment, the first type doped area 511 is an N+ type extrinsic semiconductor layer, and the second type doped area 513 is an undoped intrinsic semiconductor layer.

The first conductive layer 540, the second conductive layer 550, the first insulation layer 520, the first type doped area 511, and the second type doped area 513 form a structure similar to a field effect transistor. The first conductive layer 540 is equivalent to a source electrode or a drain electrode of the field effect transistor. The second conductive layer 550 and the first insulation layer 520 are respectively equivalent to a gate electrode and a gate insulation layer of the field effect transistor. The first type doped area 511 is equivalent to a source doped area or a drain doped area of the field effect transistor. The second type doped area 513 is equivalent to a substrate of the field effect transistor.

In this embodiment, the material of the N+ type extrinsic semiconductor for forming the first type doped area 511 is the same as a semiconductor material for forming a source/drain doped area of the switch 221. The material of the intrinsic semiconductor for forming the second type doped area 513 is the same as a semiconductor material for forming the substrate of the switch 221. Therefore, the foregoing structure that is similar to the field effect transistor and is formed by first conductive layer 540, the second conductive layer 550, the first insulation layer 520, the first type doped area 511, and the second type doped area 513 has operating features similar to those of the switch 221.

Specifically, when the voltage of the switching signal SW is greater than a specific voltage value to turn on the corresponding switch 221, a large quantity of carriers in the first type doped area 511 are attracted to the second type doped area 513, so that resistance of the second type doped area 513 greatly decreases, and the second type doped area 513 displays an attribute similar to that of a conductor. When the voltage of the switching signal SW is less than the foregoing specific voltage value to turn off the corresponding switch 221, because carriers in the first type doped area 511 are not attracted to the second type doped area 513 any more, so that the resistance of the second type doped area 513 is considerably high, and the second type doped area 513 displays an attribute similar to that of an insulator. In other words, the resistance of the second type doped area 513 falls when the voltage of the switching signal SW rises, and rises when the voltage of the switching signal SW falls.

During implementation, the first type doped area 511 and the second type doped area 513 may be implemented by using semiconductor procedure steps of manufacturing the source/drain doped area and the substrate of the switch 221.

FIG. 6 is a simplified cross-sectional view of an operation embodiment of the anti-interference unit 430 in FIG. 5. As shown in FIG. 6, when the voltage of the switching signal SW is greater than a specific voltage to conduct the switch 221, the second type doped area 513 displays an attribute similar to that of a conductor due to injection of a large quantity of carriers from the first type doped area 511. Therefore, a capacitor 610 is formed between the second conductive layer 550 and the second type doped area 513.

Specifically, the second conductive layer 550 and the second type doped area 513 respectively form two electrodes of the capacitor 610, and the first insulation layer 520 forms a dielectric layer of the capacitor 610.

On the other hand, when the voltage of the switching signal SW is less than the specific voltage to turn off the switch 221, carriers of the first type doped area 511 are not injected into the second type doped area 513 any more, so that the second type doped area 513 displays an attribute similar to that of an insulator. In this case, the second type doped area 513 cannot be used as an electrode of the capacitor 610, and the capacitor 610 is not formed between the second conductive layer 550 and the second type doped area 513.

In other words, when the switch 221 is conducted, the anti-interference unit 430 forms an equivalent capacitor (that is, the capacitor 610) on the anti-interference signal line 210, so as to increase equivalent capacitance of the anti-interference signal line 210. In addition, when the switch 221 is turned off, the anti-interference unit 430 does not form an equivalent capacitor on the anti-interference signal line 210. In this way, the capacitance of the equivalent capacitor on the anti-interference signal line 210 may be dynamically approximated to the capacitance of the load capacitor on the switching signal line 240.

During implementation, the material for manufacturing the anti-interference unit 430 may be determined according to operating characteristics of the switch 221. For example, in some embodiments in which the switch 221 is implemented by a P type field effect transistor, the first type doped area 511 is a P+ type extrinsic semiconductor layer, and the second type doped area 513 is an undoped intrinsic semiconductor layer.

In some embodiments in which the foregoing switch 21 is implemented by a P type field effect transistor, when the voltage of the switching signal SW is less than a specific voltage to conduct the switch 221, the second type doped area 513 is equivalent to a conductor. Therefore, the capacitor 610 is formed between the second conductive layer 550 and the second type doped area 513.

On the other hand, when the voltage of the switching signal SW is greater than a specific voltage to turn off the switch 221, the second type doped area 513 is equivalent to an insulator, and cannot be used as an electrode of the capacitor 610. Therefore, the capacitor 610 is not formed between the second conductive layer 550 and the second type doped area 513.

In addition, a first type low doped area with a doping type the same as that of the first type doped area 511 but with a relatively low doping concentration may be disposed between the first type doped area 511 and the second type doped area 513 according to procedure requirements.

For example, in some embodiments, the first type doped area 511 is an N+ type extrinsic semiconductor layer, and the second type doped area 513 is an undoped intrinsic semiconductor layer. A first type low doped area is disposed between the first type doped area 511 and the second type doped area 513, and the first type low doped area is an N− type extrinsic semiconductor layer. In other words, in these embodiments, the second type doped area 513 is located in a closed area formed by the first type low doped area, the first insulation layer 520, and the surface 503 of the substrate 501.

In these embodiments, because the doping type of the first type low doped area is the same as the doping type of the first type doped area 511, when the voltage of the switching signal SW is greater than a specific voltage to conduct the switch 221, carriers of the same type in the first type low doped area and the first type doped area 511 are injected into the second type doped area 513, so that the second type doped area 513 is equivalent to a conductor. In this case, the capacitor 610 is formed between the second conductive layer 550 and the second type doped area 513.

On the other hand, when the voltage of the switching signal SW is less than a specific voltage to turn off the switch 221, carriers of the same type in the first type low doped area and the first type doped area 511 are not injected into the second type doped area 513, so that the second type doped area 513 is equivalent to an insulator. In this case, the capacitor 610 is not formed between the second conductive layer 550 and the second type doped area 513.

Based on the above, the anti-interference display panel 200 transmits the anti-interference signal XSG by using the anti-interference signal line 210, so as to reduce the interference caused, by means of the capacitance coupling effect, by the switching signal SW to the active area 230.

In addition, the anti-interference unit 430 can dynamically approximate the capacitance of the equivalent capacitor on the anti-interference signal line 210 to the capacitance of the load capacitor on the switching signal line 240, and dynamically approximate the resistance of the equivalent resistor on the anti-interference signal line 210 to the resistance of the load resistor on the switching signal line 240. Therefore, a pulse signal caused by the anti-interference signal XSG in the active area 230 can be approximately reversely symmetrical to a pulse signal caused by the switching signal SW in the active area 230. In this way, the anti-interference effect of the anti-interference display panel 200 may be further improved.

In addition, the structure, similar to a field effect transistor, in the anti-interference unit 430 may be implemented by using a semiconductor procedure the same as that of the switch 221. Therefore, the difficulty of implementing the anti-interference display panel 200 by using the existing procedure device and technology is greatly reduced.

Some words are used in the specification and claims to refer to specific elements. However, a person of ordinary skill in the art should understand that same elements may be referred to by using different nouns. In the specification and claims, name differences are not used as means to distinguish elements; instead, functional differences of the elements are used as distinguishing standards. "Include" mentioned in the specification and claims is an open-ended term, and therefore should be explained as "include but not limited to". In addition, "coupling" herein includes any direct and indirect connection means. Therefore, if it is described in the text that a first element is coupled to a second element, it indicates that the first element may be directly connected to the second element by means of electrical connection, wireless transmission, optical transmission, and other signal connection methods, or the first element may be indirectly electrically or signal-connected to the second element by means of other elements or other connection methods.

The description manner of "and/or" used herein includes any combination of one or more listed items. In addition, unless otherwise particularly specified, any word in a singular form includes the meaning of the word in a plural form.

The foregoing are merely preferred embodiments of the present invention, and any equivalent variation and modification made according to the claims of the present invention shall fall within the scope of the present invention.

What is claimed is:

1. An anti-interference display panel, comprising:

a source driving chip, for generating a data signal;

a switching signal line, for transmitting a switching signal;

a multiplexer, for receiving the data signal and the switching signal, and for outputting the data signal according to the switching signal; and an anti-interference signal line, for transmitting an anti-interference signal, wherein an equivalent resistor and an equivalent capacitor are formed on the anti-interference signal line, and resistance of the equivalent resistor is approximate to resistance of a load resistor coupled to the switching signal line, and capacitance of the equivalent capacitor is approximate to capacitance of a load capacitor coupled to the switching signal line;

wherein the anti-interference signal falls when the switching signal rises, and the anti-interference signal rises when the switching signal falls.

2. The anti-interference display panel according to claim 1, wherein the anti-interference signal line has a first area and a second area for forming the equivalent resistor on the anti-interference signal line.

3. The anti-interference display panel according to claim 2, wherein the first area is wider than the second area.

4. The anti-interference display panel according to claim 1, wherein the anti-interference signal line comprises an anti-interference unit, for enabling the equivalent capacitor to be formed on the anti-interference signal line, and the anti-interference unit comprises:

a semiconductor layer, disposed on a surface of a substrate;

a first insulation layer, bonded to the surface of the substrate and the semiconductor layer;

a second insulation layer, bonded to the first insulation layer;

a first conductive layer, partially bonded to the semiconductor layer; and a second conductive layer, located between the semiconductor layer and the first conductive layer, and for receiving the switching signal, wherein the first insulation layer and the second insulation layer cover the second conductive layer.

5. The anti-interference display panel according to claim 4, wherein the semiconductor layer comprises:

a first type doped area, bonded to the first conductive layer; and a second type doped area, located in a closed area formed by the first type doped area, the first insulation layer, and the surface of the substrate.

6. The anti-interference display panel according to claim 4, wherein the semiconductor layer comprises:

a first type doped area, bonded to the first conductive layer;

a first type low doped area, bonded to the first type doped area; and a second type doped area, located in a closed area formed by the first type low doped area, the first insulation layer, and the surface of the substrate.

7. The anti-interference display panel according to claim 5, wherein the second type doped area overlaps with at least one part of a projection of the second conductive layer on the substrate.

8. The anti-interference display panel according to claim 5, wherein resistance of the second type doped area falls when the switching signal rises, and resistance of the second type doped area rises when the switching signal falls.

9. An anti-interference signal line, for transmitting an anti-interference signal to reduce a coupling effect caused by a switching signal on a switching signal line, comprising:

an equivalent resistor, wherein resistance of the equivalent resistor is approximate to resistance of a load resistor coupled to the switching signal line; and an equivalent capacitor, wherein capacitance of the equivalent capacitor is approximate to capacitance of a load capacitor coupled to the switching signal line, wherein the anti-interference signal falls when the switching signal rises, and the anti-interference signal rises when the switching signal falls.

10. The anti-interference signal line according to claim 9, wherein the anti-interference signal line has a first area and a second area for forming the equivalent resistor on the anti-interference signal line.

11. The anti-interference signal line according to claim 10, wherein the first area is wider than the second area.

12. The anti-interference signal line according to claim 9, wherein the anti-interference signal line comprises an anti-interference unit, for enabling the equivalent capacitor to be formed on the anti-interference signal line, and the anti-interference unit comprises:

a semiconductor layer, disposed on a surface of a substrate;

a first insulation layer, bonded to the surface of the substrate and the semiconductor layer;

a second insulation layer, bonded to the first insulation layer, wherein the first insulation layer and the second insulation layer cover the switching signal line;

a first conductive layer, partially bonded to the semiconductor layer; and a second conductive layer, located between the semiconductor layer and the first conductive layer, and for receiving the switching signal, wherein the first insulation layer and the second insulation layer cover the second conductive layer.

13. The anti-interference signal line according to claim 12, wherein the semiconductor layer comprises:

a first type doped area, bonded to the first conductive layer; and a second type doped area, located in a closed area formed by the first type doped area, the first insulation layer, and the surface of the substrate.

14. The anti-interference signal line according to claim 12, wherein the semiconductor layer comprises:

a first type doped area, bonded to the first conductive layer;

a first type low doped area, bonded to the first type doped area; and a second type doped area, located in a closed area formed by the first type low doped area, the first insulation layer, and the surface of the substrate.

15. The anti-interference signal line according to claim 13, wherein the second type doped area overlaps with at least one part of a projection of the second conductive layer on the substrate.

16. The anti-interference signal line according to claim 13, wherein resistance of the second type doped area falls when the switching signal rises, and resistance of the second type doped area rises when the switching signal falls.

17. The anti-interference display panel according to claim 6, wherein the second type doped area overlaps with at least one part of a projection of the second conductive layer on the substrate.

18. The anti-interference display panel according to claim 6, wherein resistance of the second type doped area falls when the switching signal rises, and resistance of the second type doped area rises when the switching signal falls.

19. The anti-interference signal line according to claim 14, wherein the second type doped area overlaps with at least one part of a projection of the second conductive layer on the substrate.

20. The anti-interference signal line according to claim 14, wherein resistance of the second type doped area falls when the switching signal rises, and resistance of the second type doped area rises when the switching signal falls.

* * * * *